United States Patent [19]

Snead

[11] Patent Number: 5,029,532

[45] Date of Patent: Jul. 9, 1991

[54] CONTROL CAB

[76] Inventor: Edwin de S. Snead, P.O. Box 1000, Georgetown, Tex. 78627

[21] Appl. No.: 288,288

[22] Filed: Dec. 22, 1988

[51] Int. Cl.[5] ..... B61D 7/00

[52] U.S. Cl. ..... 105/239; 414/339

[58] Field of Search ..... 105/238.1, 241.1, 239, 105/248; 303/20; 414/527, 528, 339, 505; 104/27, 30, 31

[56] References Cited

U.S. PATENT DOCUMENTS

| | | | |
|---|---|---|---|
| 1,907,974 | 5/1933 | Johnston . | |
| 2,948,234 | 8/1960 | Hughson | 104/26 |
| 3,096,056 | 7/1963 | Allison | 246/187 |
| 3,217,662 | 11/1965 | Hughson et al. | 105/1 |
| 3,293,549 | 12/1966 | Patterson | 325/64 |
| 3,380,399 | 4/1968 | Southard et al. | 105/61 |
| 3,384,032 | 5/1968 | Ruff | 303/20 X |
| 3,532,878 | 10/1970 | Morrill et al. | 303/20 X |
| 3,778,813 | 12/1973 | Bull | 303/20 X |
| 4,582,280 | 4/1986 | Nichols et al. | 246/182 |
| 4,652,057 | 3/1987 | Engle et al. | 303/20 X |
| 4,708,402 | 11/1987 | Kanda | 303/20 |

FOREIGN PATENT DOCUMENTS 2451518 5/1976 Fed. Rep. of Germany ..... 414/527

*Primary Examiner*—Robert J. Oberleitner
*Assistant Examiner*—Mark T. Le
*Attorney, Agent, or Firm*—Harrison & Egbert

[57] ABSTRACT

A self-unloading train having a locomotive, a plurality of hopper cars, a discharge car and a control cab. The plurality of hopper cars have an underlying conveyer for the receipt of material from the hopper cars. The hopper cars are detachably connected to the locomotive. The discharge car is connected to the hopper cars opposite the locomotive for transferring the material from the underlying conveyer. The control cab is positioned at the end of the train opposite the locomotive. The control cab has a transmitter contained therewithin for controlling the movement of the locomotive from a remote location. The control cab is a compartment positioned at the end of the discharge car opposite the hopper cars. This compartment has a window on the wall of the compartment opposite the hopper cars. The transmitter is a radio transmitter positioned within the control cab for transmitting digitized signals to a receiver positioned within the locomotive.

8 Claims, 5 Drawing Sheets

CONTROL CAB

TECHNICAL FIELD

The present invention relates to trains for the transportation of bulk commodities. More particularly, the present invention relates to apparatus used for the remote operation of railroad locomotives. Still more specifically, the present invention relates to a control cab for use at the end of a self-unloading conveyer train.

BACKGROUND ART

Rail transportation is generally recognized as being more economical than truck transportation of bulk commodities, such as aggregates. Large quantities of such commodities can be moved by a small crew at low cost. However, rail transportation frequently loses out in competitive situations because of the cost of unloading, stockpiling, and delivering the commodity to the ultimate destination.

Even though large quantities of bulk material can be transported at low cost from one terminal to another, the burden is placed on the unloading facility to maintain the economics of this method of transportation for the purchaser of the commodity. If the unloading is slow, and the train is therefor delayed for a substantial period of time for the unloading to be accomplished, there is an added investment cost per ton handled for the use of the railroad equipment. One problem in this regard, is that rail transportation is a twenty-four hour operation while many of the industries it serves operate only during daylight hours. Often a train makes good speed from origin to destination, only to be delayed several hours waiting to be unloaded. Each hour or delay adds to the transportation cost as much as an additional 25 to 50 miles of haul.

To accommodate these problems, the present inventor developed a self-unloading train for bulk commodities. This invention was patented as U.S. Pat. No. 4,925,356, issued on May 15, 1990, and entitled "Self-Unloading Train for Bulk Commodities." The self-unloading train overcomes many of the above-discussed disadvantages of rail transportation for bulk materials by utilizing a plurality of hopper cars and a discharge car. This train is pulled by a conventional locomotive. Each of the hopper cars include several hoppers having bottom discharge openings and associated gates for discharging onto an endless belt conveyer which runs the entire length of the train. The discharge car includes a transfer conveyer which receives the material from the train conveyer and is movable on the trailer car to transfer the material to a selected point relative to the train. When the self-unloading train moves along a straight section of track, the material may be deposited in a windrow alongside the track by the transfer conveyer. Alternatively, the unit train may be unloaded while stationary, with the transfer conveyer discharging onto a portable stacking conveyer, for example, which will enable the deposit of material in piles thirty feet high and at least forty feet away from the track, for example. As such, the self-unloading train of this invention has achieved a large number of advantages not fond in conventional unit train design.

Another advantage of this self-unloading train is the fact that the train can unload immediately upon arrival at the destination and immediately depart back to the source for another load. The most intensely used pieces of railroad equipment, at present, are the rotary dumping hopper cars used in unit train coal service. Under ideal conditions, these coal trains can be unloaded in rotary dumping sites as fast or possibly faster than the self-unloading train. However, these rotary dumping facilities and the associated conveyer and stacking equipment needed to make them operate effectively cost millions of dollars, generally more than the cost of the coal trains that they service. Also, these rotary dumping hopper cars are restricted to one location for their entire working lives.

The out-of-pocket or direct costs associated with rail transportation are primarily fuel, labor, and recovery of or amortization of capital investment. Of these three, fuel is the only true direct cost in that it is being consumed only when the train is in motion, either loaded or unloaded.

Labor is somewhere in between indirect and direct costs. From a long term view, trainmen will be hired or laid off when the management can see for months ahead that traffic will be either heavy or light. However for an individual train, a crew is called to start at certain times of the day with the expectation that they will work a certain number of hours, either eight, ten, or twelve hours. With this knowledge in mind, the crew works with a plan to move the train a certain number of miles. For travelling more than a hundred miles, the crew receives extra money, but for less than a hundred miles, they are paid by the hour. Therefore, any delay in operating the train generally results in a higher labor cost and expediting the movement results in a lower labor cost.

Amortization of equipment, both rolling and fixed, is a truly fixed cost. There is very little difference between the maintenance required on a heavily used section of track compared with a lightly used section of track. Time and weather cause deterioration that must be corrected and paid for, regardless of the amount of traffic moved. Therefore, the amortization cost of the railway and structures is inversely proportional to the revenue-ton miles carried.

Operational experience with the first self-unloading trains, of the above-described patent application, have indicated that the maintenance cost is very light, probably only about 10% of the amortization cost. It has been shown that 1000 ton trains, rented for months at a time, at a rate of $1,300 per calendar day, have a maintenance cost of about $100 per day or about one-eighth of the amortization cost. Again, this shows that the cost per revenue ton mile is inversely proportional to the rate of utilization.

Ordinary railroad equipment, particularly individual cars, spend most of their lives sitting still. Although the overall average train speed is 25 or 30 miles per hour, the average speed of an individual car is only 50 miles per day, or approximately two miles per hour. From this, it can be seen that railroad cars spend a large part of their entire life sitting still, waiting to be loaded or unloaded. To some extent, the same thing is true of trains in general.

Even though the railroads have a 3-to-1 advantage in fuel economy and a 20 or 50-to-1 in labor economy, the rates per revenue-ton mile are roughly comparable. This is because of the low utilization of railroad equipment.

The invention of the self-unloading train, which consists of eleven hopper cars that carry a total of 1000 tons of bulk material, plus a discharge car carrying the prime mover and the lateral conveyer, can be pulled by one 1700 to 2000 horsepower locomotive. Unfortunately, most of the rules of railroads require that the locomotive travel on the head end of the train.

"Y's" or loops where a train can change directions end-for-end are not common. Frequently, on short hauls, the type of work the self-unloading train most commonly encounters, there is a necessity for the engine to run around the train. Although the train may be able to unload in a short time on a main line track, before it can go back to the source for another load, must be moved to some location where there is passing track where the engine can disconnect and run around to the other end. Both getting to an appropriate passing track and making the connection requires time. In addition, time is needlessly wasted in reestablishing the brake airlines and testing the brakes. This type of complicated operation can seldom be done in less than 15 minutes.

Since the self-unloading train is frequently used on short hauls where two, three, or four trips may be made in a single shift, this wasted time can easily be the difference between making three trips in a day or four trips in a day. Since the fuel cost is very low and the labor and amortization costs are high, the fourth trip is almost all profit, up to $1,000 or more per trip. It becomes a substantial economic benefit to be able to avoid the transaction in which the locomotive must be changed to the forward end of the train.

It is an object of the present invention to provide a control cab for use on a self-unloading train.

It is another object of the present invention to provide a control cab with proper controls for the remote operation of the locomotive of the train.

It is still another object of the present invention to provide a control cab that fits conveniently beneath the conveyer structure on the discharge car of a self-unloading train.

It is still another object of the present invention to provide a control cab that complies with federal requirements of safety.

These and other objects and advantages of the present invention will become apparent from a reading of the attached specification and appended claims.

SUMMARY OF THE INVENTION

The present invention is a self-unloading train that comprises a plurality of hopper cars having an underlying conveyer, a discharge car connected to the plurality of hopper cars, a locomotive connected to the other end of the hopper cars, and a control cab positioned at the end of the train opposite the locomotive. The underlying conveyer of the hopper cars is for the receipt of material from the hopper cars. These hopper cars are detachably connected to the locomotive. The discharge car serves to transfer material from the underlying conveyer. The control cab has a transmitter contained therewithin for communicating with the locomotive and for controlling the movement of the locomotive.

The control cab is a compartment positioned at the end of the discharge car opposite the hopper cars. This compartment has a window on the wall of the compartment opposite the hopper cars. The window of the compartment is comprised of bullet-proof glass. The transmitter of the control cab is a radio transmitter positioned within the compartment for transmitting digitized signals to a receiver within the locomotive. These digitized signals include a four-digit code that is included with each transmission. If the receiver on the locomotive does not receive the proper digitized code, then the transmitted signal is ignored and the locomotive enters a braking mode. There is constant interaction between the transmitter on the control cab and the receiver in the locomotive. The interactive signal acts as a fail-safe mechanism for the control cab system. The transmitter serves to remotely actuate the throttle and the brakes of the locomotive. Suitable controls are contained within the control cab for selectively activating the throttle and the brakes of the locomotive.

A headlamp is affixed to the exterior of the control cab so as to direct a beam outwardly from the discharge car. A horn is also affixed to the exterior of the control cab compartment.

The present invention is also a bi-directional transfer car for a self-unloading train that comprises a railstock, a first conveyer affixed to the upper surface of the railstock, a transfer conveyer having a first end fastened beneath the end of the first conveyer and to the upper surface of the railstock, and a control cab affixed to the top surface of the railstock and beneath the second end of the transfer conveyer. The railstock is of a type capable of travelling along a railroad track. The first conveyer serves to transfer material angularly upwardly. Ideally, the first conveyer passes material from the underlying conveyer of the self-unloading train. The transfer conveyer extends angularly upwardly from its first end. The second end of the transfer conveyer is distal from the upper surface of the railstock. The transfer conveyer is movable angularly about a pivot point at the first end of the transfer conveyer. The control cab includes suitable controls for the movement of the transfer conveyer and for controlling the direction of discharge from the transfer conveyer.

DETAILED DESCRIPTION OF THE INVENTION

Figure 1:
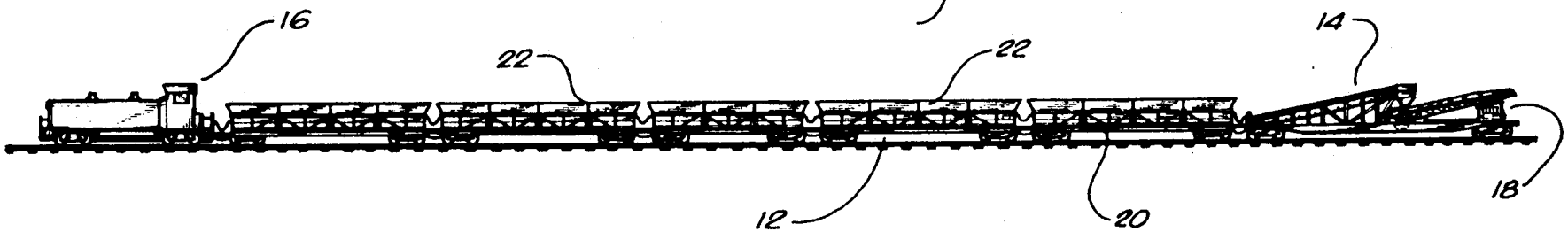
FIG. 1 is a view, in side elevation, of the self-unloading train having a control cab affixed at the end of the train.

Referring to FIG. 1, there is shown a side view of the self-unloading train 10 in accordance with the present invention. Self-unloading train 10 includes a plurality of hopper cars 12, a discharge car 14, a locomotive 16, and a control cab 18. The plurality of hopper cars 12 have an underlying conveyer 20 for the receipt of material from the hoppers 22 of the hopper car configuration 12. These hopper cars are detachably connected to locomotive 16. The discharge car 14 is connected to the hopper cars 12 for transferring material from the underlying conveyer 20. The control cab 18 is positioned at the end of the train opposite the locomotive 16. The control cab has a transmitter contained therewithin for controlling the movement of the locomotive 16 and the associated plurality of hopper cars 12.

The train 10, according to the invention, may be referred to as a "unit train", in the sense that the cars of the train are permanently coupled together, and would not be uncoupled unless it is necessary to remove one of the cars to a service facility. The self-unloading train 10, according to the invention, is particularly suitable for the transport of aggregates. The train illustrated in FIG. 1 shows a total of five hopper cars. In typical operation, the train 10 would have a total of ten or more hopper cars. The illustration of the five hopper car configuration is for the convenience of illustration.

The hopper cars 12 are designed to support an endless belt train conveyer 20, which traverses the length of the train 10 including the hopper cars 12 and a portion of the discharge car 14. The train conveyer 20 underlies the discharge gates of the hoppers.

The hopper cars 12 are of generally conventional construction including a main frame consisting of a center sill and side beam members, which are supported on suitable trucks in a conventional manner. While this particular form of basic rail car structure is illustrated, it will be understood that the hopper car may be constructed using other known techniques where the center sill is eliminated. Each of the hopper cars has a bottom discharge opening that is quite wide and long. The discharge opening is closed by suitable clam shell gate members (not shown) consisting of a pair of coacting members which are movable toward and away from each other in a direction transverse to the longitudinal axis of the hopper car. The underlying conveyer 20 has a width substantially greater than that of the hopper discharge openings. Typically, this width is about 33% greater than the discharge opening. The conveyer 20 includes a supply belt and a return belt. The supply belt is the upper run of an endless belt conveyer and is supported in the form of a trough. This trough confronts the discharge openings of the hoppers 22. The return belt is supported immediately under the supply belt in a flat condition.

Locomotive 16 is detachably connected to the plurality of hopper cars 12. Locomotive 16 is a conventional railroad locomotive that has sufficient horsepower to pull the plurality of loaded hopper cars 12. Within locomotive 16 are suitable controls available for remote actuation by the control mechanisms within control cab 18.

Figure 3:
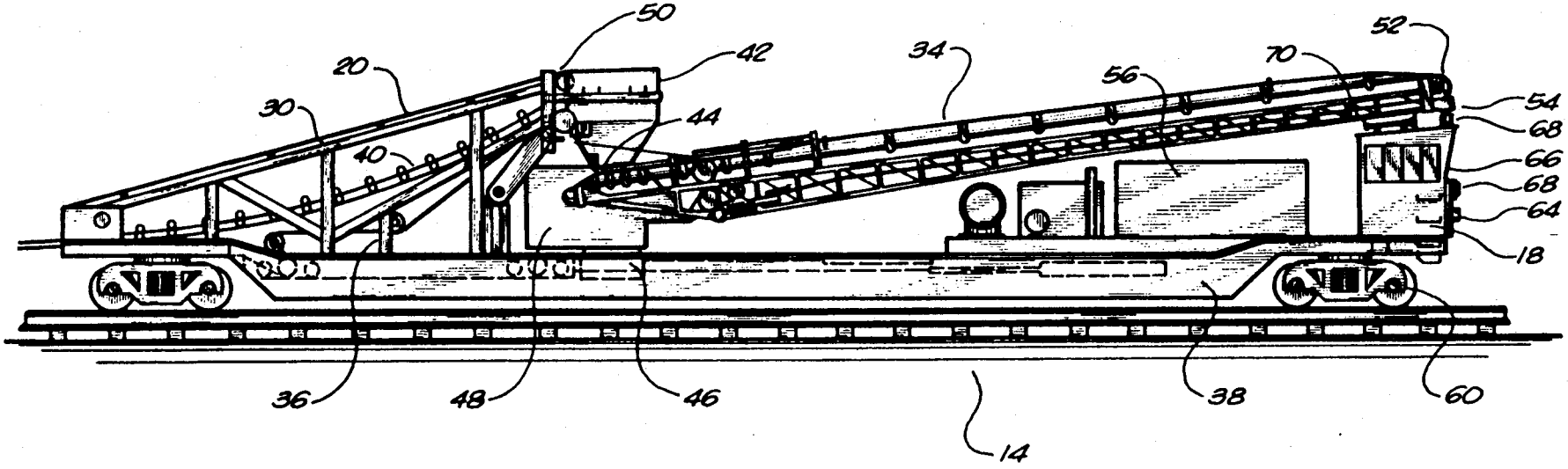
FIG. 3 is a detailed view, in side elevation, of the discharge car and control cab of the present invention.

FIG. 3 is a detailed view of the discharge car 14. Discharge car 14 is a multi-purpose car and, as best seen in FIG. 3, may consist of a conventional flatbed car carrying certain structures to be described hereinafter. The portion of the train conveyer 20 which is carried on the discharge car 14 is a first conveyer 30 which elevates the conveyed material for discharge onto a transfer conveyer 34. The first conveyer 30 is supported by suitable frame structure 36 on the trailer car 14. In particular, structure 36 is supported on railstock 38.

Of particular interest is the "cover belt" configuration of first conveyer 30. In the conveying of material from the train conveyer 20, a cover belt 40 is utilized so as to maintain the material in proper position on the conveyer 30. Upon the approaching discharge into hopper 42, the cover belt will separate from the conveyer 30 so as to allow material to be quickly and properly released into the hopper 42 for discharge onto the first end 44 of transfer conveyer 34.

The transfer conveyer 34 is an elongated endless belt conveyer having a length of 30 feet or more, for example, which is carried at the rearward end of the discharge car 14. The first end 44 of the transfer conveyer 34 is mounted on a platform 46 with counterweight 48. The first end 44 of transfer conveyer 34 underlies the rearward end 50 of first conveyer 30. The transfer conveyer 34 is supported on platform 46 so as to rotate relative to the vertical axis of the platform 46 so as to position its second (or discharge) end 52 at any desired point. During transit, the transfer conveyer 34 is carried as illustrated in FIG. 3 in longitudinal alignment with the discharge car 14. The discharge end 52 of the transfer conveyer 34 is placed immediately above the top 54 of the control cab 18. The transfer conveyer 34 is also pivotable, relative to the platform 46, about a horizontal transverse axis, so that the rearward end 52 of the conveyer 34 may be elevated as desired. This is accomplished by means of a hydraulic lift cylinder (not shown). The transfer conveyer 34 is preferably provided with hydraulically powered means (not shown) for rotating the conveyer relative to the axis of platform 46. In this manner, the discharge end 52 of the transfer conveyer 34 can be positioned where desired, to discharge the material from the train conveyer 20 into other transport vehicles, onto another conveyer, onto piles adjacent to the track, or onto the track behind the discharge car 14.

The discharge car 14 may also carry power generating apparatus 56 for operating the conveyer system described. The first conveyer 30 and the second conveyer 34 are preferably driven by suitable electric motors; and the power for these motors may be generated by suitable electric generator 56 driven by a suitable internal combustion engine such as a diesel engine. The generator 56 may also provide power for auxiliary apparatus such as a portable stacking conveyer.

The discharge car 14 may also include a suitable control panel or station within control cab 18 for the operation and control of the several above-described components, including generator 56, the motors for the train conveyer 20, the transfer conveyer 34, and the associated hydraulic mechanisms for both rotating and changing the height of the transfer conveyer, and possibly the mechanism for controlling the tension on the train conveyer 20.

As can be seen in FIG. 3, the control cab 18 is mounted by bolting, welding, or other means, to the top of railstock 38. As shown in FIG. 3, the control cab 18 is mounted to the rearwardmost position on railstock 38, directly above the trucks 60. Control cab 18 is a compartment for accommodating an operator 62 at a position at the end of the train. The control cab 18 is shown with a bell 64 mounted on wall 66. Wall 66 is the wall of the control cab 18 that is opposite of the conveyer 20. In addition, headlamps 68 are fastened to the wall 66 of control cab 18 for directing beams of light outwardly and rearwardly of train 10. A horn 70 is mounted to the top of control cab 18 so as to direct a loud sound outwardly from the discharge car 14. Each of these components operate to form the structure of control cab 18. As shown in FIG. 3, control cab 18 acts as a "artificial" locomotive. In other words, control cab 18 fulfills the federal requirements for locomotive construction. As such, it is permissible under federal rules to allow the control cab 18 to act as the forward portion of a train. Control cab 18 will act as the forward portion while the locomotives are being driven in reverse. The use of control cab 18 eliminates the need to realign the locomotive with respect to the discharge cars 12.

Figure 4:
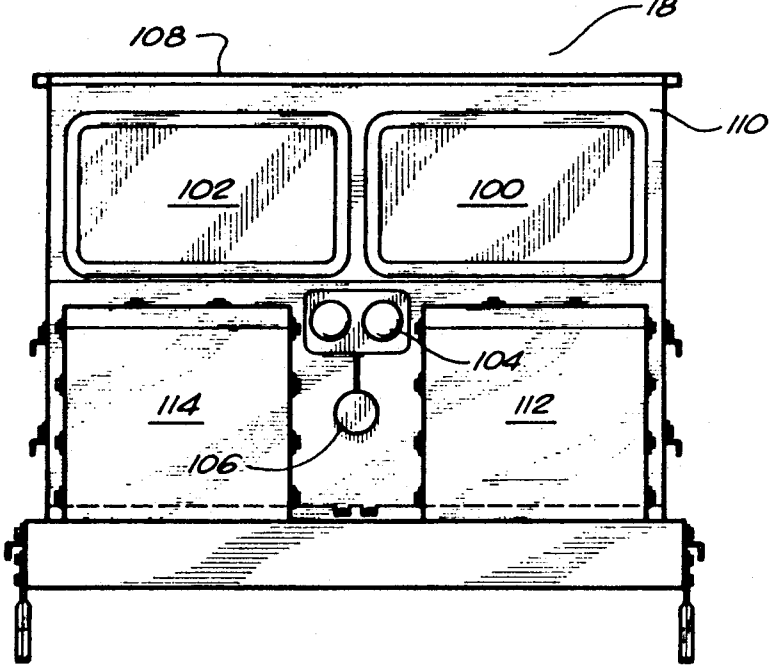
FIG. 4 is a frontal view of the control cab of the present invention.

FIG. 4 shows a forward view of control cab 18. As can be seen, the forward portion of control cab 18 includes a pair of windows 100 and 102, lights 104, and bell 106. As can be seen, the control cab 18 is a compartment having a generally rectangular configuration. The roof 108 is generally flat and overlies the compartment so as to keep a sealed configuration. Windows 100 and 102 are formed in wall 110 so as to allow the operator of the control cab 18 to view in a forward direction during the use of control cab 18. Windows 100 and 102 are comprised of bullet-proof glass. It is a federal requirement that locomotives have bullet-proof glass so as to prevent flying objects from penetrating the glass and injuring the operator. Control cab 18 imitates the locomotive by incorporating such bullet-proof glass in windows 100 and 102. Panels 112 and 114 contain the electrical circuitry and other mechanisms for control cab 18. Panels 112 and 114 are bolted to the wall 110.

Figure 5:
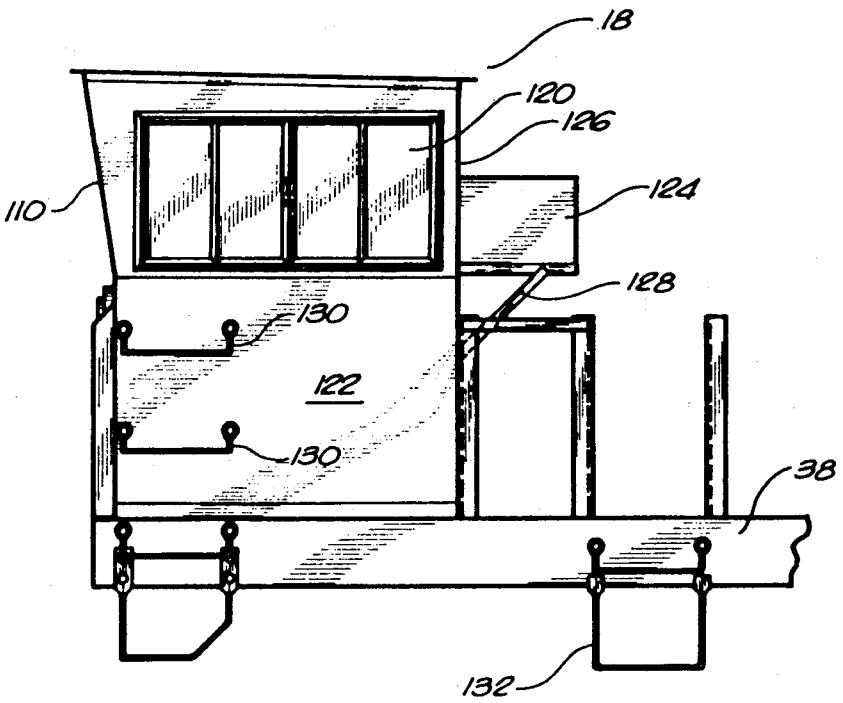
FIG. 5 is a side view of the control cab of the present invention.

FIG. 5 is a side view of control cab 18. As can be seen in FIG. 5, the forward wall 110 of control cab 18 is tilted slightly forward. A window 120 is formed in the side wall 122 of control cab 18. Window 120 is a sliding window arrangement that allows the operator to open and close window 120 as desired. Air conditioner 124 is fitted to the rearward portion 126 of control cab 18. A framework 128 supports air conditioning unit 124 in its proper position rearward of control cab 18. A ladder 130 is attached to the exterior of wall 122 allowing crewmen to support themselves on control cab 18. Another ladder 132 is positioned on railstock 38 rearward of control cab 18. Ladder portion 132 allows the crewmen to enter the rearward portion 126 of the control cab 18. A door (not shown) is attached by hinges, or other means, to the wall 126.

Figure 6:
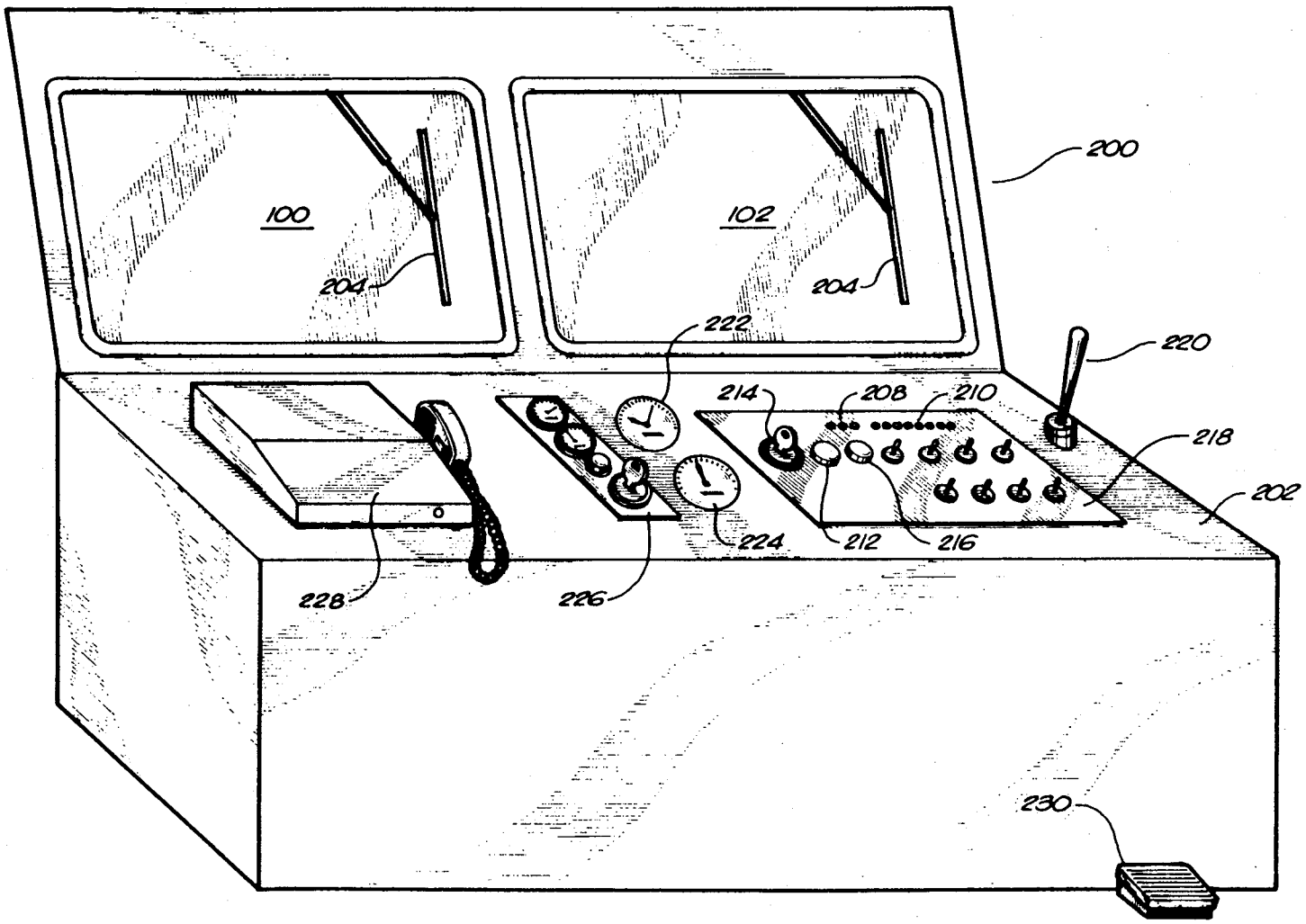
FIG. 6 is an illustration of the control panel of the control cab of the present invention.

Importantly, FIG. 6 shows the interior 200 of control cab 18. It can be seen that windows 100 and 102 are positioned for easy viewing by the operator of the control panel 202 of control cab 18. Windows 100 and 102 have associated windshield wiper mechanisms 204 operably attached thereto.

Control panel 202 is positioned for optimum ergonomic access by the operator of the control cab. Importantly, the control panel 202 is in communication with the receiver on the locomotive 16 of the self-unloading train 10. The systems are in radio communication and, in particular, in the transmission of digital signals. The signaling mechanism is related to the use of operating signals in model aircraft flying and other remote control devices. The digitized signal includes a four digit code that is transmitted with each signal. The receiver in the locomotive receives the transmitted digitized signal and digital code and actuates the appropriate throttle or brake mechanism on the locomotive in response to the signal generated from control cab 18. If the four digit does not match the prerecorded code in the receiver in the locomotive, then the signal will be treated as void and will not serve to actuate the throttle or the brake of the locomotive. In addition, the control cab includes a receiver that constantly communicates with a transmitter in the locomotive. In other words, the control cab 18 and the locomotive are in constant communication. If there is an event that causes an interruption of this constant communication, then the brakes of the locomotive will be automatically applied and the train will stop. Any interference with the transmissions will cause such an event to occur. It is beyond the realm of possibility that a digitized code, identical with that of the four digit transmitted code, could be introduced so as to be interactive with the signals between the control cab and the locomotive.

As shown in FIG. 6, the control panel includes three lights 208 which are the throttle position indicators. These indicators show a forward, neutral or reverse position on the throttle There are eight throttle level indicators lights 210. If all eight lights are illuminated, then the locomotive will be operating at full throttle. The main power indicator light 212 indicates that the system is either on or off. The system is actuated by the turning of key 214 in the control panel 202. An electric power to radio control system indicator light 216 is placed adjacent to the main power indicator. A variety of toggle switches 218 are positioned on control panel 202. These switches include a rear marker switch, a gage and panel light switch, a locomotive horn switch, a locomotive bell switch, a locomotive brake switch, train brake switch, and an engine shut down switch. The bell of the train is actuated by the movement of lever 220. Guages 222 and 224 are positioned to the left of the control panel 202. Guage 222 is a temperature guage and guage 224 is an oil pressure gauge. Various pressure guages for train line pressure, brake cylinder pressure, and diesel generator set compressor reservoir pressure are positioned at panel 226. A cellular telephone 228 is also positioned on the left of control panel 202. Cellular telephone 228 allows verbal communication with the outside world thru ordinary telephones. A deadman switch 230, in the form of a foot panel, is positioned on the floor of the control cab 18. Deadman switch 230 requires the placement of the operator's foot in order to allow the control cab to move forward. In the event that the operator's foot is removed from deadman switch 230, the train will come to an immediate halt by the actuation of the brake system on the train. The deadman switch 230 requires continual pressure by the operator in order to allow the train to move forward. This is a safety mechanism in the event that the operator becomes incapacitated in some way, falls to the floor, or is otherwise unable to operate the control cab in a safe manner.

Various other mechanisms are positioned within the control cab for the convenience of the operator. A manual cab horn and cab bell are positioned within the cab so as to allow the operator to actuate these in the same manner that the operator of a locomotive would actuate such horn and such bell. The control panel includes switches for the diesel generator, preheat switches, and key controls to the diesel generator. For the benefit of the operator, a refrigerator and an air conditioner are included for the comfort of the control cab operator. The cab complies with the Federal Railroad Administration (F.R.A.) noise level requirements and includes proper insulation for meeting such requirements. There are two adjustable locomotive cab seats positioned within the control cab. A hand-held remote control with charging unit for the radio control system is included within the cab for the convenience and use of the operators outside of the control cab. The windows 100 and 102 are safety glazed F.R.A. approved windows.

Figure 2:
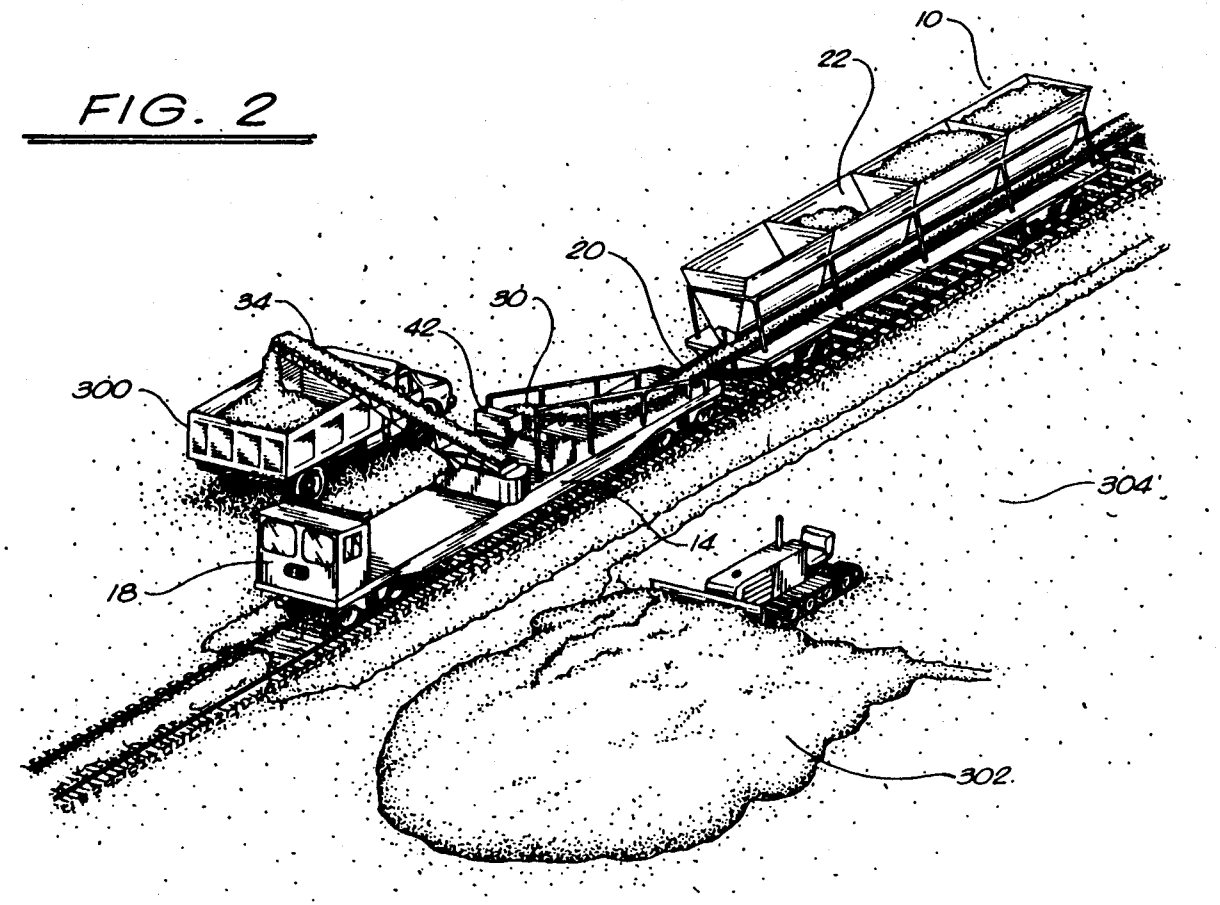
FIG. 2 is a perspective view showing the operational configuration of the control cab, the discharge car, and the underlying conveyer of the present invention.

FIG. 2 shows the operation of the present invention in a perspective view. As can be seen, the control cab 18 is positioned at one end of the train 10. The transfer conveyer 34 is unloading a load of conveyed material, such as aggregate, or other bulk material, into a dump truck 300. The transfer conveyer 34 is being fed by the first conveyer 30 by passing the material from conveyer 30 through hopper 42 and onto the first end (the rotatable portion) of the transfer conveyer 34. As can be seen, the first conveyer 30 is part and parcel of the train conveyer 20. It can be seen that the material is discharged from the hoppers 22 of the plurality of hopper cars 12 onto the train conveyer 20. The material then passes to the first conveyer 30 and thereonto the transfer conveyer 34. Hoppers 22 are filled with an aggregate material. The hoppers 22 may be selectively unloaded onto the conveyer 20 for the purpose of discharge onto dump truck 300 or for discharge into a pile 302.

Control cab 18 may then act as the forward portion of the train 10 following the dumping operation. In other words, the locomotives will bring the train 10 to the job site 304. When at the job site 304, the train conveys the load and discharges the load into the desired location. The transfer conveyer 34 may be actuated, rotated, and otherwise manipulated from within the control cab 18 or by suitable mechanisms located on the exterior of the discharge car 14. Following the discharge of the material, the control cab 18 then becomes the forward portion of the train. When it is desired to return to the loading site, the control cab 18 will cause an appropriate signal to actuate the locomotive power, in reverse, so as to cause the train 10 to move in the reverse direction, with control cab 18 forward. In this sequence of events, there is no need to disconnect the locomotive, no need to find the track that will allow the rearranging of locomotive and hopper cars, and no need for the waste and delay of such manipulations. As such, the present invention allows a greater number of loads to be transported each day without the need for excessive manipulation of the train components. By using the control cab, the train can go with equal speed and safety in either direction without the necessity for ever having the engine return to the forward portion of the train. Insofar as the control cab meets the requirements of the F.R.A. for proper safety, the operator of the control cab can operate the train in perfect safety and with proper efficiency.

It should be noted that the description given herein describes the control cab as used in conjunction with a self-unloading train. This should not be considered a limitation on the present invention. The control cab will function appropriately on any train configuration. For example, the control cab also could be used on a gondola train. The description of the self-unloading train is only for the preferred embodiment of the invention.

The embodiments as illustrated and discussed in the specification are intended only to teach those skilled in the art the best way known by the inventor to make and use the invention. Nothing in the specification should be considered as limiting the scope of the present invention. Many changes could be made by those skilled in the art to produce equivalent systems without departing from the invention. The present invention should be limited only by the following claims and their legal equivalents.

I claim:

1. A self-unloading train comprising:

a locomotive;

a plurality of hopper cars having an underlying conveyor for the receipt of material from said hopper cars, said hopper cars detachably connected to said locomotive, each of said hopper cars having a bottom discharge opening for effecting discharge of said material from said opening by gravity, said underlying conveyor comprising an endless belt supported on said cars underlying said hopper discharge opening to receive material discharged therefrom and extending for the length of said plurality of hopper cars, said underlying conveyor having a width greater than the width of said discharge opening;

gate means positioned at the discharge opening of said hopper cars, said gate means being operable selectively to discharge material from said hopper cars onto said underlying conveyor;

a discharge car connected to said hopper cars for transferring material from said underlying conveyor;

a control cab positioned at the end of said train opposite said locomotive, said control cab affixed to said discharge car, said control cab having a transmitter means contained therein for controlling the movement of said locomotive, said control cab comprising:

a compartment positioned at the end of said discharge car opposite said hopper cars, said compartment having a window on the wall of said compartment opposite said hopper cars.

2. The train of claim 1, said transmitter means further comprising:

a multi-channel radio transmitter for directing verbal communications to receivers external of said train.

3. The train of claim 1, said window comprised of bullet-proof glass.

4. The train of claim 1, said transmitter means comprising:

a radio transmitter positioned within said control cab for transmitting digitized signals to a receiver position within said locomotive.

5. The train of claim 4, said radio transmitter having a digital code included with each transmission of said radio transmitter, said receiver in said locomotive acknowledging and acting upon said digital code.

6. The train of claim 1, said transmitter means for remotely actuating the throttle and the brakes of said locomotive, said transmitter means including controls positioned within said control cab for selectively actuating the throttle and the brakes of said locomotive.

7. The train of claim 1, further comprising:

a headlamp affixed to the exterior of said wall opposite said hopper oars, said headlamp directed outwardly from said discharge car.

8. The train of claim 1, further comprising:

a horn affixed to the exterior of said wall opposite said hopper cars, said horn directed outwardly from said discharge car.

* * * * *